US008157133B2

(12) United States Patent
Sawicki

(10) Patent No.: US 8,157,133 B2
(45) Date of Patent: Apr. 17, 2012

(54) INVERTED DISPENSER FITMENT

(75) Inventor: Craig R. Sawicki, Roselle, IL (US)

(73) Assignee: TricorBraun Inc., St. Louis, MO (US)

( * ) Notice: Subject to any disclaimer, the term of this patent is extended or adjusted under 35 U.S.C. 154(b) by 292 days.

(21) Appl. No.: 12/428,720

(22) Filed: Apr. 23, 2009

(65) Prior Publication Data

US 2009/0294481 A1 Dec. 3, 2009

Related U.S. Application Data

(60) Provisional application No. 61/056,491, filed on May 28, 2008.

(51) Int. Cl.
*B65D 37/00* (2006.01)

(52) U.S. Cl. ..... 222/207; 222/212

(58) Field of Classification Search ..... 222/206, 222/207, 211–213, 547, 563, 564
See application file for complete search history.

(56) References Cited

U.S. PATENT DOCUMENTS 4,186,882 A * 2/1980 Szczepanski ..... 239/327
4,324,349 A * 4/1982 Kaufman ..... 222/207
5,145,094 A 9/1992 Perlmutter
6,109,810 A 8/2000 Flores et al.
6,394,315 B1 * 5/2002 Banks ..... 222/190
6,398,076 B1 6/2002 Giblin et al.
6,672,487 B1 * 1/2004 Lohrman ..... 222/213
D509,738 S 9/2005 Kovara et al.
6,938,800 B1 9/2005 Lehmkuhl
7,097,076 B1 8/2006 Giblin et al.
7,100,785 B1 9/2006 Suffa

* cited by examiner

*Primary Examiner* — Darren W Gorman

(74) *Attorney, Agent, or Firm* — H. Frederick Rusche; Husch Blackwell LLP

(57) ABSTRACT

An inverted dispenser for a squeezable bottle is provided. The dispenser includes an outer portion having a frusto-conical body with a cavity extending therethrough. A lip extends circumferentially around the frusto-conical body. The dispenser also includes an inner portion having a cylindrical faceplate that includes a spout extending axially from a center of the faceplate. The inner portion is positioned within the outer portion such that the inner portion faceplate is positioned within the outer portion lip. The inner portion is further positioned such that the spout is in fluid communication with the cavity extending through the outer portion. In one embodiment, the inverted dispenser is formed with the outer portion and the inner portion molded as a single piece.

18 Claims, 7 Drawing Sheets

INVERTED DISPENSER FITMENT

CROSS REFERENCE TO RELATED APPLICATIONS

This application claims priority and benefit of U.S. Provisional Patent Application No. 61/056,491, filed on May 28, 2008 all of which are incorporated herein by reference.

BACKGROUND OF THE INVENTION

1. Field of the Invention

The present invention relates to a dispenser for a bottle and, more particularly, to an inverted dispenser for a squeezable bottle.

2. Related Art

Squeezable bottles are commonly used for storing liquids and gels. Often, such bottles include dispensers that retain the liquid or gel within the bottle until pressure is applied to the bottle to release the liquid or gel. However, such bottles require that the bottle be inverted to dispense the contents therein. Accordingly, despite having a dispensing mechanism designed to retain the liquid or gel, the bottle often leaks prior to having pressure applied thereto. Accordingly, it is desirable to have a bottle that can be inverted and not leak. The present invention provides such a bottle through the means of an inverted dispenser.

SUMMARY OF THE INVENTION

An inverted dispenser for a squeezable bottle is provided, wherein the inverted dispenser prevents leaks while the bottle is positioned upside down. Further, the inverted dispenser enables a fluid or gel within the bottle to be dispensed therefrom, when pressure is applied to the bottle. In addition, the inverted dispenser of the present invention enables a seal to be positioned over an insert of the inverted dispenser and underneath a cap. Accordingly, the fluid or gel within the bottle is protected from tampering and/or early expiration.

In one embodiment, a bottle having an inverted dispenser is provided, wherein the bottle includes a body having at least one sidewall, a bottom, and a top. The inverted dispenser is positioned at the top of the bottle and is in fluid communication with a cavity of the bottle. The inverted dispenser includes an outer portion having a frusto-conical body having a sidewall, a closed bottom end, and an open top end. A cavity extends from the closed bottom end through the open top end. A faceplate extends circumferentially around the top end. An inner portion having a cylindrical faceplate is positioned within the outer portion. The cylindrical faceplate of the inner portion includes a spout extending axially from a center of the faceplate. A cylindrical dispensing tube extends axially from the spout. The inner portion is positioned within the outer portion such that the inner portion faceplate is positioned within the outer portion lip. The inner portion is further positioned such that the dispensing tube extends through the cavity in the outer portion without contacting the closed bottom end of the outer portion. The outer portion is positioned within the top of the bottle such that the outer portion lip rests on an end surface of the bottle top.

In another embodiment, an inverted dispenser is provided, wherein the inverted dispenser includes an outer portion and an inner portion. The outer portion has a frusto-conical body and an opening extending therethrough. A lip extends circumferentially around the frusto-conical body. The inner portion has a cylindrical faceplate including a spout extending axially from a center of the faceplate. The inner portion is positioned within the outer portion such that the inner portion faceplate is positioned within the outer portion lip, and such that the spout is in fluid communication with the cavity extending through the outer portion. The inner portion is configured to be secured within the outer portion by friction, a tongue and groove, and/or a screw thread.

In an alternative embodiment, an insert for an inverted dispenser is provided, wherein the insert includes a frusto-conical body having a sidewall, a bottom end, and a top end forming a cavity therein. An opening extends through the sidewall and is positioned adjacent to the top end, and a spout extends axially from a center of the top end. The insert also includes a cylindrical dispensing tube that extends axially from the spout and through the cavity without contacting the bottom end such that the spout is in fluid communication with the cavity through the dispensing tube.

In a further embodiment, a method of forming an inverted dispenser for a bottle is provided. The method includes forming an outer portion having a frusto-conical body and a cavity extending through the frusto-conical body, and extending a lip circumferentially around the frusto-conical body. The method further includes forming an inner portion having a cylindrical faceplate, and axially extending a spout from a center of the faceplate. The inner portion is positioned within the outer portion such that the inner portion faceplate is positioned within the outer portion lip, and such that the spout is in fluid communication with the cavity extending through the outer portion. The inner portion is also positioned within the outer portion so that a surface of the spout of the inner portion is substantially planar with a surface of the lip of the outer portion. In addition, an opening is extended through the sidewall of the outer portion so that the cavity of the outer portion is in fluid communication with a cavity of a bottle when the inverted dispenser is positioned within the bottle. The method also includes extending a dispensing tube from the spout and through the cavity in the outer portion without contacting a bottom end of the outer portion.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
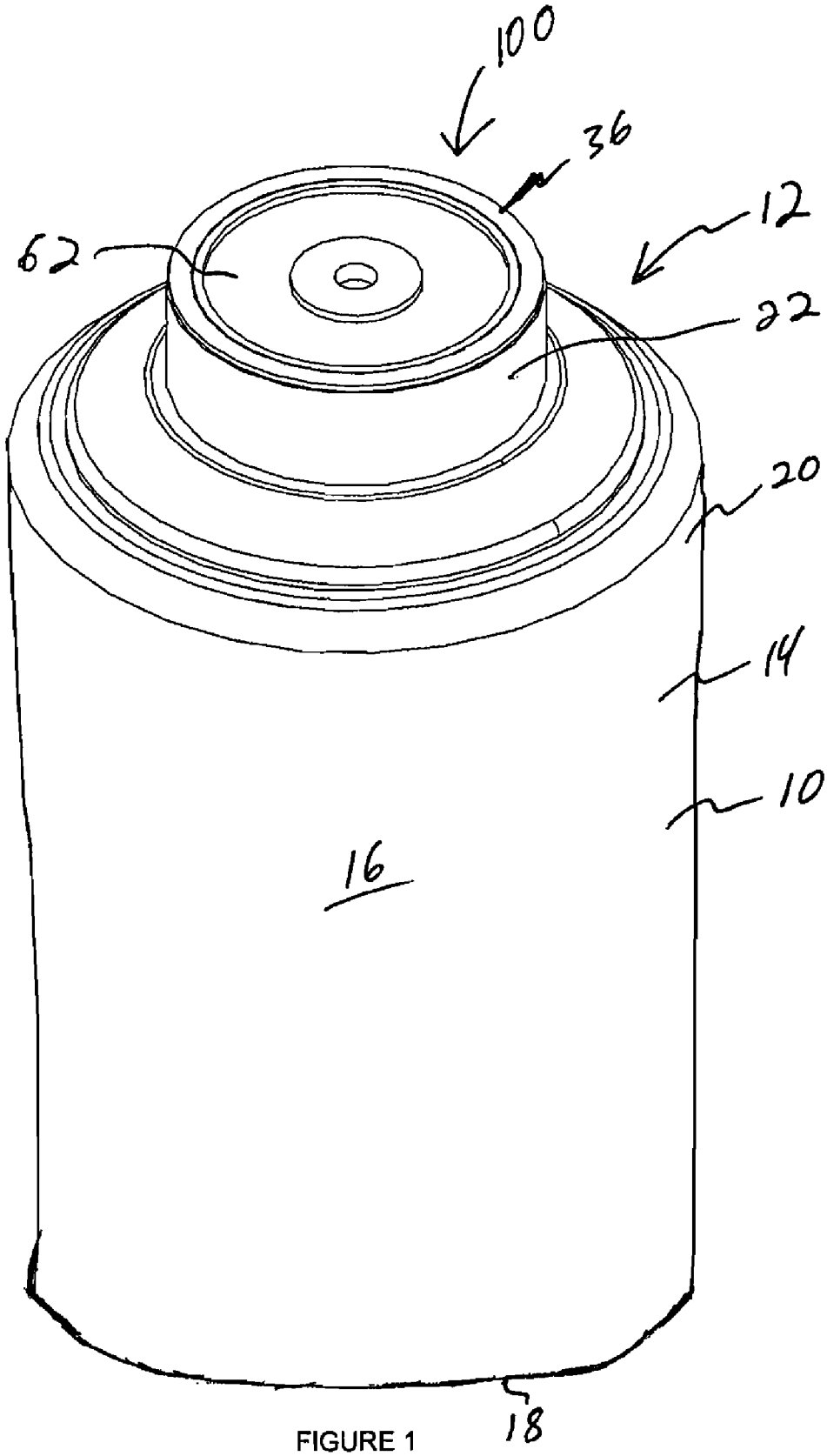
FIG. 1 is a perspective view of a bottle having the inverted dispenser of the present invention.
Figure 2:
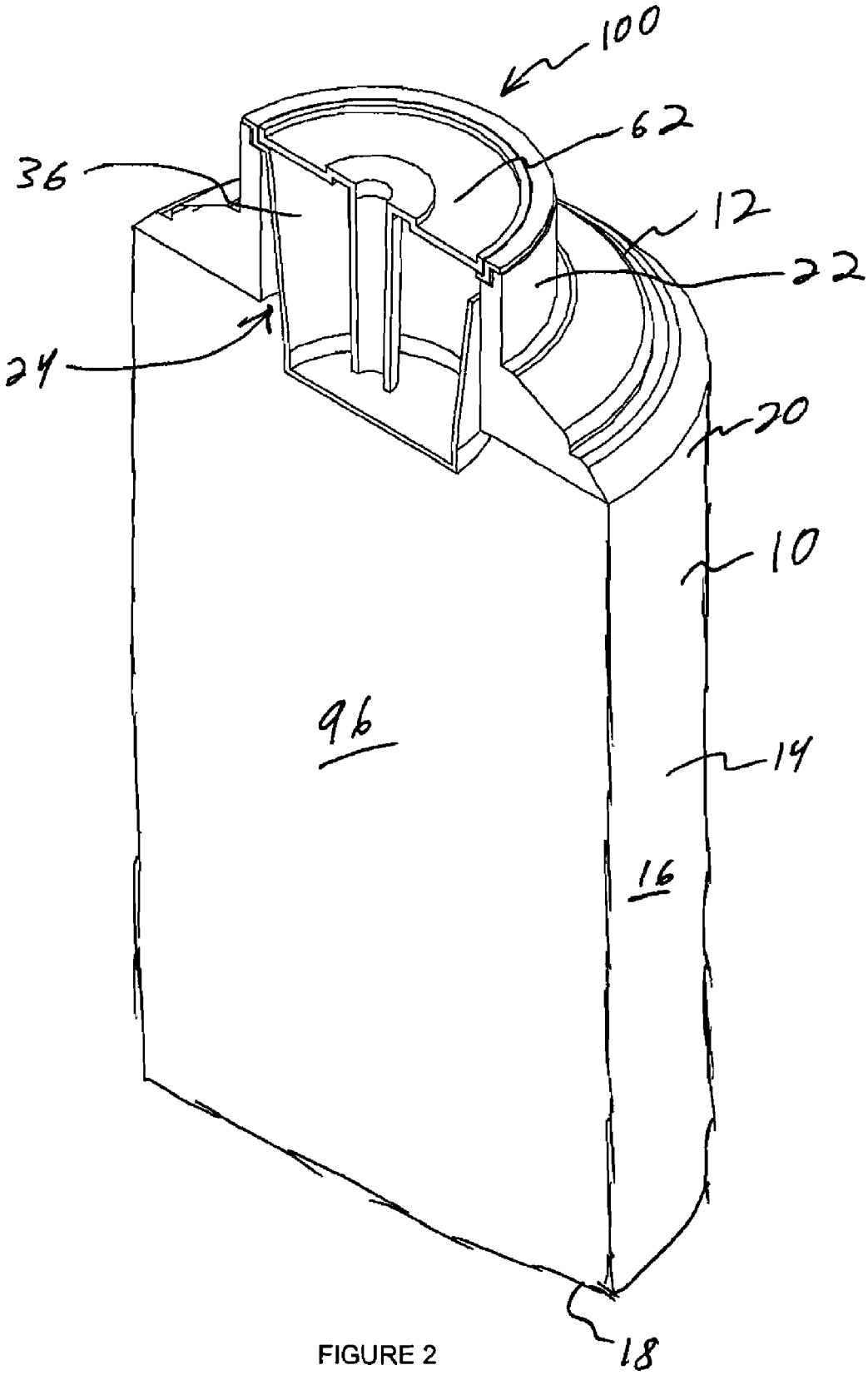
FIG. 2 is a cross-sectional view of the bottle shown in FIG. 1.
Figure 3:
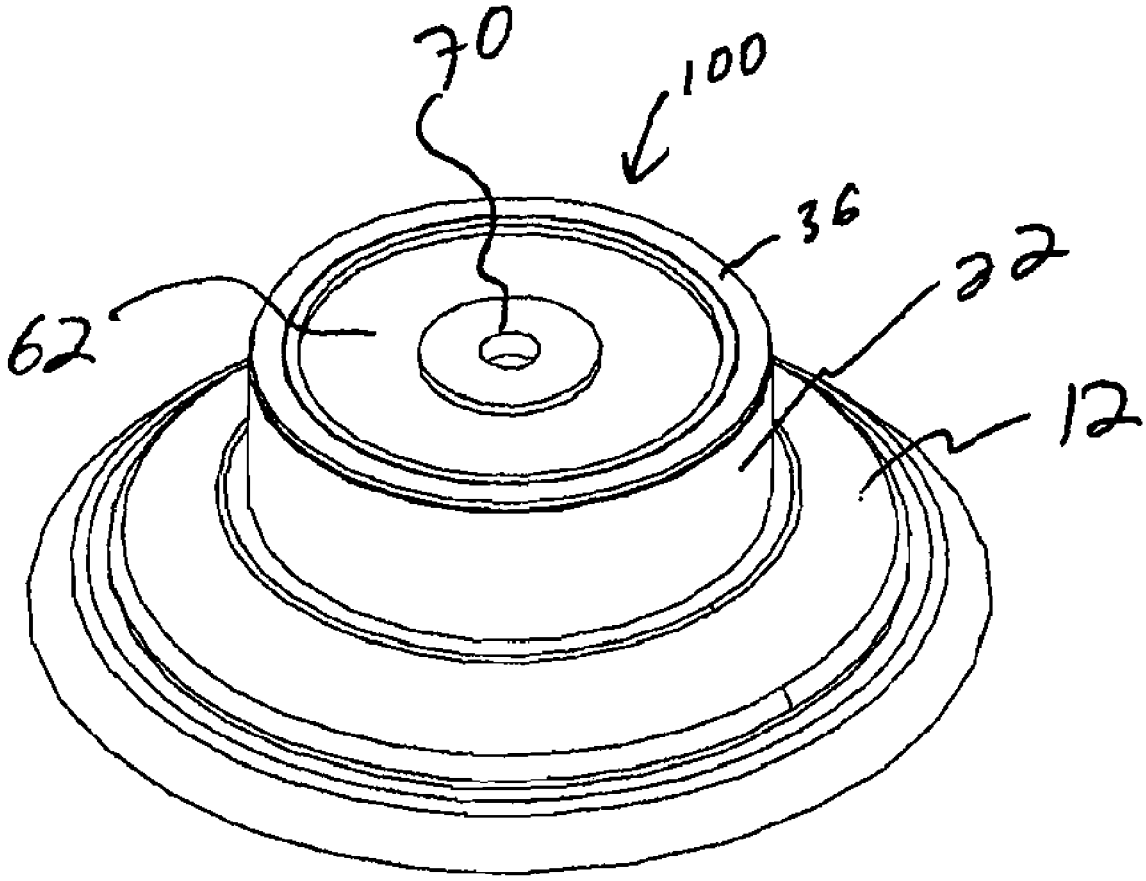
FIG. 3 is a perspective view of the inverted dispenser of the present invention.
Figure 4:
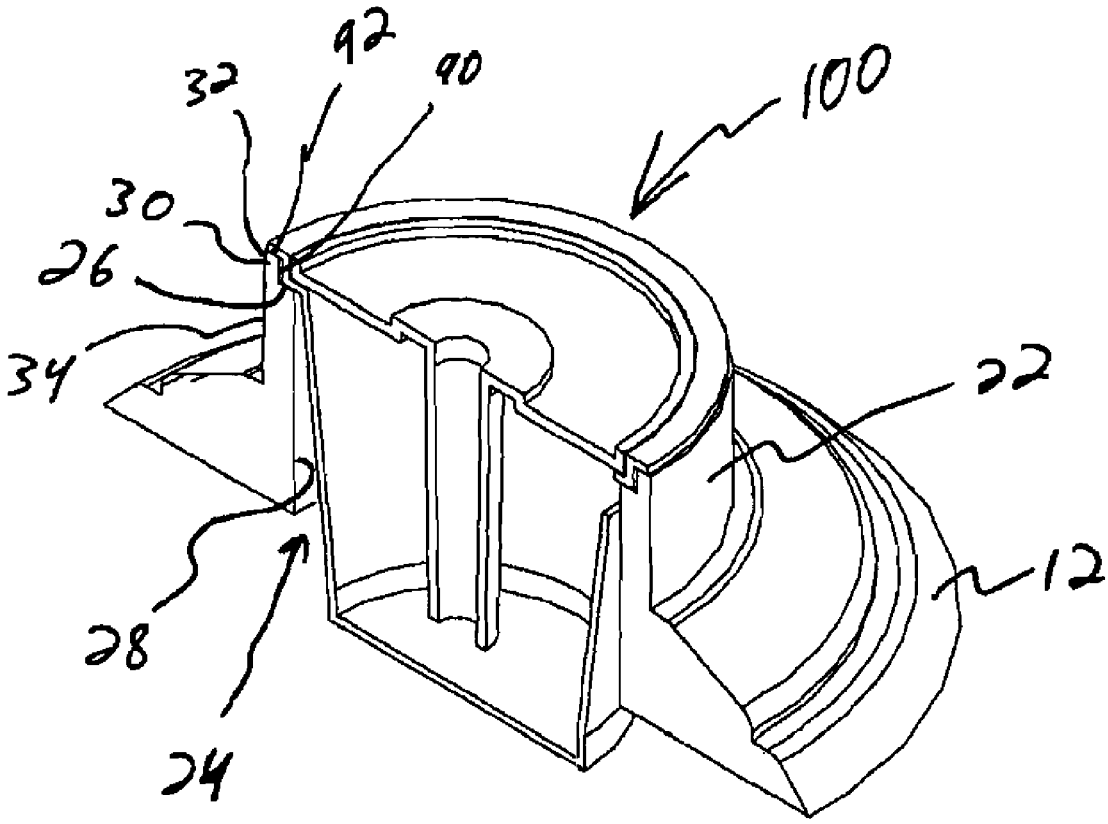
FIG. 4 is a cross-sectional view of the inverted dispenser shown in FIG. 3.
Figure 5:
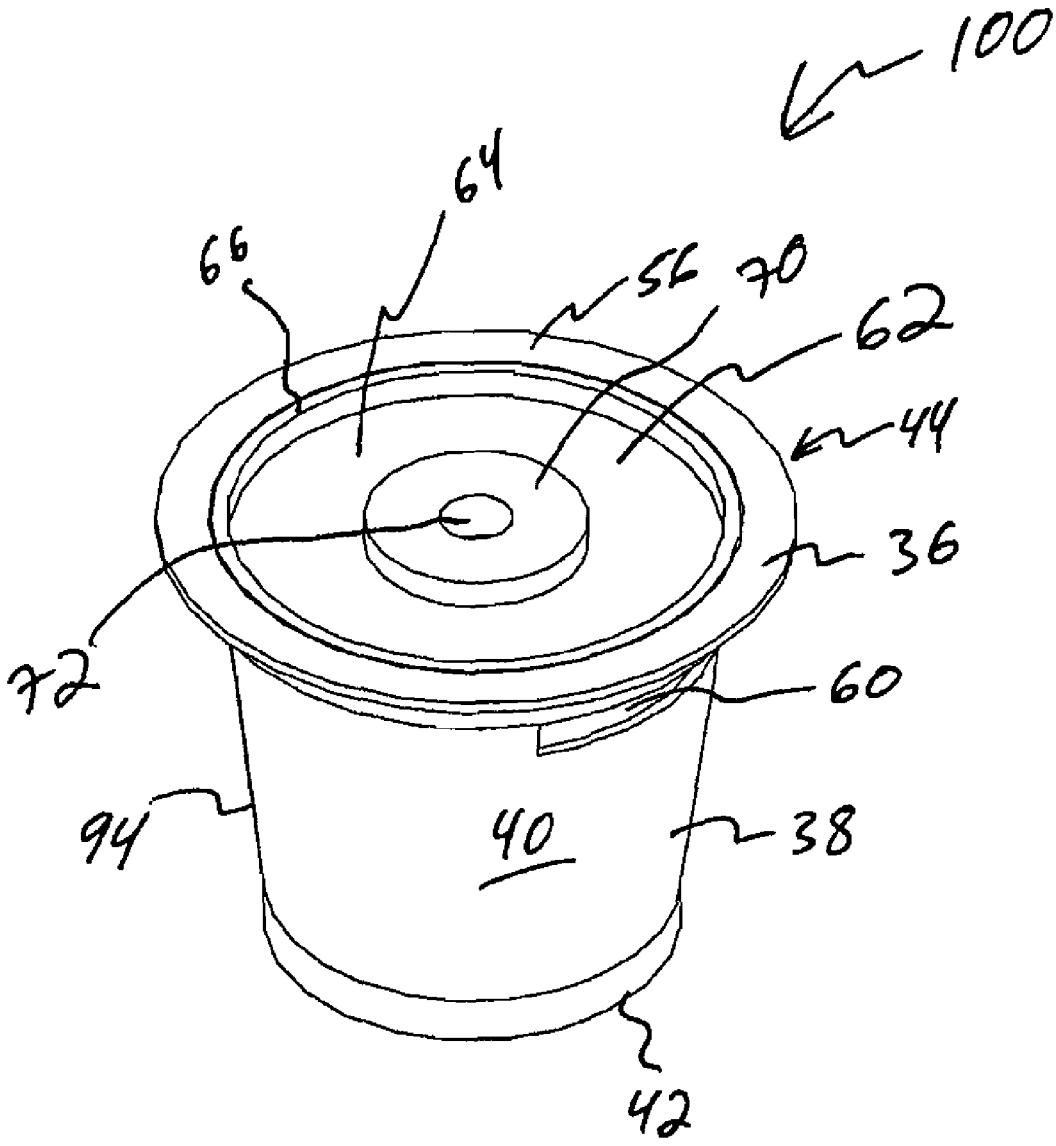
FIG. 5 is a perspective view of the insert used with the inverted dispenser shown in FIG. 3.
Figure 6:
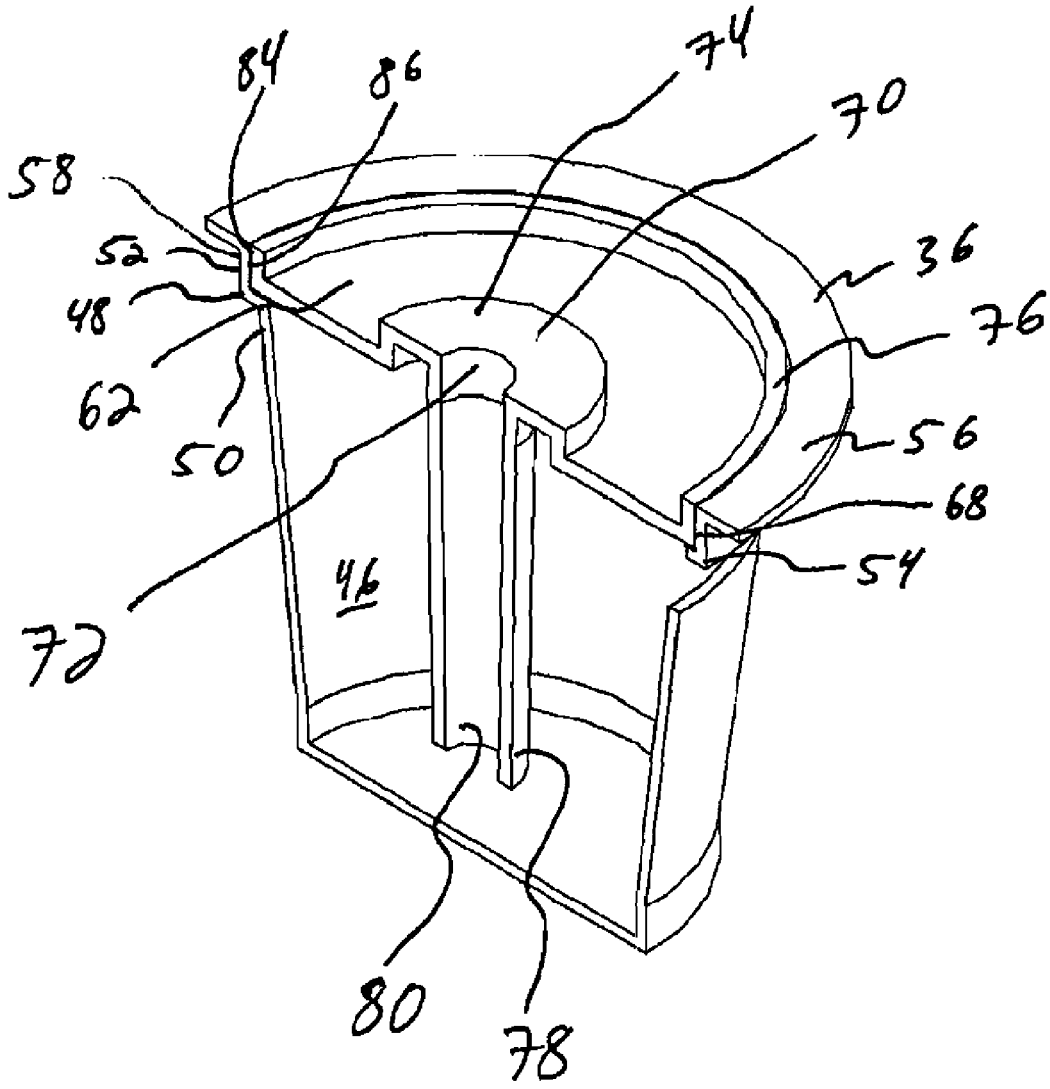
FIG. 6 is a cross-sectional view of the insert shown in FIG. 5.
Figure 7:
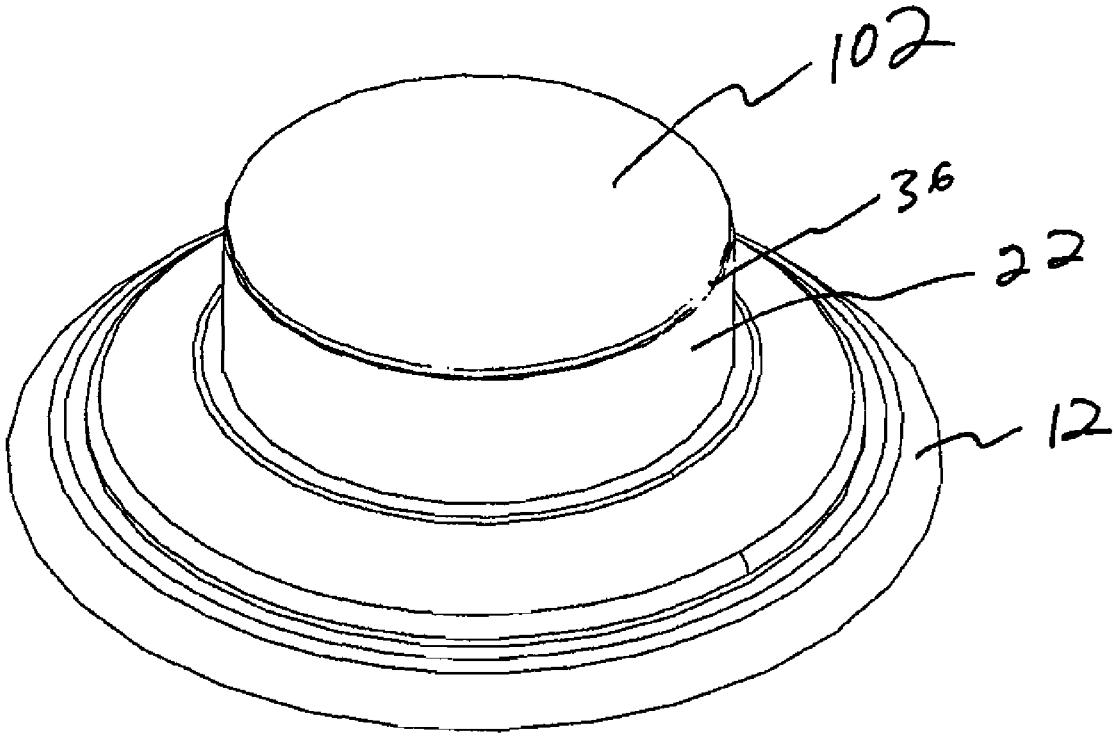
FIG. 7 is a perspective view of the inverted dispenser shown in FIG. 3 having a seal attached thereto.

FIGS. 1-7 illustrate a bottle 10 having an inverted dispenser 12 in accordance with the present invention. The bottle 10 includes a body 14 and an insert 100 including an outer portion 36 and an inner portion 62. In one embodiment, the inner portion 62 and the outer portion 36 are molded as a single piece. The body 14 has at least one sidewall 16, a bottom 18, and a top 20 that form an inner cavity 96. The body 14 is configured to house a fluid, gel, or other flowable material therein. The inverted dispenser 12 extends axially from the top 20 and is in fluid communication with the inner cavity 96. Insert 100 is positioned within the inverted dispenser 12 to retain the fluid or gel with the bottle 10, when the bottle 10 is held in an inverted position. The fluid or gel is retained until pressure is applied to the bottle 10 and the fluid or gel is dispensed from the insert 100.

The inverted dispenser has a cylindrical body 22 with an opening 24 extending therethrough. The inverted dispenser 12 also includes a ledge 26 extending circumferentially along an inner surface 28 of the body 22. An end ring 30 extends axially from the ledge 26 and has an outer surface 32 that is planar to an outer surface 34 of the body 22. The insert 100 is configured to be received within opening 24 such that a portion of the insert 100 is positioned on the ledge 26.

The outer portion 36 of insert 100 has a frusto-conical body 38 including a sidewall 40, a closed bottom end 42, and an open top end 44. A cavity 46 extends from the closed bottom end 42 and through the open top end 44. The frusto-conical body 38 also includes a ledge 48 extending circumferentially around an outer surface 50 of the top end 44. An end ring 52 extends axially from an outer edge 54 of the ledge 48, and a circular lip 56 extends circumferentially from an outer surface 58 of the end ring 52. The frusto-conical body 38 further includes an opening 60 that extends through the sidewall approximate to the top end 44 and below the ledge 48 of the frusto-conical body 38. The opening 60 provides a passage for the fluid or gel to flow from within the bottle 10 into the cavity 46 that extends through the frusto-conical body 38.

The outer portion 36 is positioned within the inverted dispenser 12 of the bottle 10 such that the ledge 48 of the outer portion 36 rests on the ledge 26 of the inverted dispenser 12. The outer portion is further positioned such that the outer surface 58 of the outer portion end ring 52 is positioned adjacent an inner surface 90 of the inverted dispenser end ring 30. Moreover, the outer portion lip 56 rests on an end surface 92 of the inverted dispenser end ring 30. Accordingly, the opening 60 through the sidewall 40 of the frusto-conical body 38 places the cavity 46 of the frusto-conical body 38 in fluid communication with the inner cavity 96 of bottle 10, when outer portion 36 is positioned within inverted dispenser 12. The outer portion 36 is positioned within the inverted dispenser 12 such that the outer portion in held in position, even when the bottle 10 is under pressure. In one embodiment, the outer portion 36 snaps into the inverted dispenser 12 and is held in position via friction and/or a tongue and groove. In another embodiment, the outer portion 36 screws into the inverted dispenser 12. In an alternative embodiment, the outer portion 36 is held in position using any suitable locking mechanism.

The inner portion 62 of insert 100 includes a cylindrical faceplate 64 having an end ring 66 extending axially from an outer edge 68 of the faceplate 64. A spout 70 extends axially from a center 72 of the faceplate 64 such that an end surface 74 of the spout 70 is substantially planar with an end surface 76 of the inner portion end ring 66. The inner portion further includes a cylindrical dispensing tube 78 extending axially from the spout 70. The dispensing tube 78 has a dispensing opening 80 extending therethrough and through the spout 70.

It is important to note, and will be appreciated by one of ordinary skill in the art, that in an embodiment where the inner portion 62 and the outer portion 36 are molded as a single piece, the lips, edges, and rings described above may not be necessary for the integrally molded insert 100.

The inner portion 62 is positioned within the outer portion 36 such that an outer edge 68 of the inner portion faceplate 64 rests on the outer portion ledge 48. Further, an outer surface 84 of the inner portion end ring 66 is positioned adjacent an inner surface 86 of the outer portion end ring 52. The inner portion 62 is positioned within the outer portion 36 such that the inner portion 62 in held in position, even when the bottle 10 is under pressure. In one embodiment, the inner portion 62 snaps into the outer portion 36 and is held in position via friction and/or a tongue and groove. In another embodiment, the inner portion 62 screws into the outer portion 36. In an alternative embodiment, the inner portion 62 is held in position using any suitable locking mechanism.

The end surface 76 of the inner portion end ring 66 is positioned planar with the outer portion circular lip 56. Further, the inner portion 62 is positioned within the outer portion 36 such that the dispensing tube 78 extends through the cavity 46 in the outer portion 36. Specifically, the spout 70 and the dispensing tube 78 are in fluid communication with the cavity 46 extending through outer portion 36. The inner portion 62 is positioned without the dispensing tube 78 contacting the closed bottom end 42 of the frusto-conical body 38.

When insert 100 is assembled within inverted dispenser 12, a seal 102 is positionable that seals insert 100 and inverted dispenser 12. Specifically, the seal 102 is attached to lip 56 such that the seal 102 extends across outer portion 36 and inner portion 62. In one embodiment, the seal 102 can also be attached to the end surface 76 of end ring 66 and/or an end surface of spout 70. The seal 102 facilitates preserving a freshness of the liquid or gel within bottle 10. The seal 102 also prevents tampering with the liquid or gel within bottle 10.

When the bottle 10 is inverted, the fluid or gel within the bottle 10 flows between an outer surface 94 of the frusto-conical body 38 of the outer portion 36 and an inner surface 28 of the cylindrical body 22 of the inverted dispenser 12. The fluid or gel then flows through the opening 60 in the frusto-conical body 38, and into the frusto-conical body 38 such that the fluid surrounds the dispensing tube 78. The fluid fills the cavity 46 of the frusto-conical body 38 but is kept via pressure from entering the dispensing tube 78. Accordingly, the inverted dispenser 12 does not leak while the bottle 10 is in the inverted position.

When pressure is applied to the body 14 of the bottle 10, the fluid flows toward the closed bottom end 42 of the outer portion 36 and into the dispensing tube 78. As more pressure is applied, the fluid flows through the dispensing tube and is dispensed from the spout 70. When the pressure is released, the insert 100 is vented such that the flow of the fluid is reversed and the fluid is returned to the body 14 of bottle 10.

As various modifications could be made to the exemplary embodiments, as described above with reference to the corresponding illustrations, without departing from the scope of the invention, it is intended that all matter contained in the foregoing description and shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A bottle comprising:

a body having at least one sidewall, a bottom, and a top;

an inverted dispenser extending axially from said top of said bottle and further comprising:

an outer portion having a frusto-conical body having a sidewall, a closed bottom end, an open top end, a cavity extending from said closed bottom end and through said open top end, a lip extending circumferentially around said top end, and an outer portion opening extending through said sidewall and positioned adjacent to said open top end;

an inner portion having a cylindrical faceplate, said cylindrical faceplate comprising a spout extending axially from a center of said faceplate, and a cylindrical dispensing tube extending axially from said spout; and said inner portion positioned within said outer portion such that said inner portion faceplate is positioned within said outer portion lip, and such that said dispensing tube extends through said cavity in said outer portion without contacting said closed bottom end of said outer portion.

2. The bottle in accordance with claim 1, wherein a seal is attached to said outer portion lip to seal said inverted dispenser.

3. The bottle in accordance with claim 1 further comprising a dispensing opening extending through said spout and said dispensing tube, and in fluid communication with said cavity in said outer portion.

4. The bottle in accordance with claim 1, wherein an inner cavity of said bottle is in fluid communication with said cavity in said outer portion via said outer portion opening.

5. The bottle in accordance with claim 4, wherein, when said bottle is inverted and pressure applied thereto, the fluid within said bottle flows through said outer portion opening, into said outer portion cavity, through said dispensing opening, and is discharged from said spout.

6. The bottle in accordance with claim 1, wherein said outer portion is secured within said inverted dispenser by at least one of friction, a tongue and groove, and a screw thread.

7. The bottle in accordance with claim 1, wherein said inner portion is secured in said outer portion by at least one of friction, a tongue and groove, and a screw thread.

8. An insert for an inverted dispenser, said insert comprising:

an outer portion having a frusto-conical body, a bottom end, a cavity extending through said frusto-conical body, a lip extending circumferentially around said frusto-conical body, and an outer portion opening extending through said frusto-conical body;

an inner portion having a cylindrical faceplate, said cylindrical faceplate comprising a spout extending axially from a center of said faceplate, and a cylindrical dispensing tube extending axially from said spout and through said cavity without contacting said bottom end; and said inner portion positioned within said outer portion such that said inner portion faceplate is positioned within said outer portion lip, and such that said spout is in fluid communication with said cavity extending through said outer portion.

9. An insert in accordance with claim 8, wherein a seal is attached to said outer portion lip to seal the inverted dispenser.

10. An insert in accordance with claim 8, wherein said outer portion further comprises a ledge extending circumferentially around said frusto-conical body, a portion of said inner portion faceplate positioned flush with said outer portion ledge when said inner portion is positioned within said outer portion.

11. An insert in accordance with claim 10, wherein said inner portion further comprises an end ring extending circumferentially around an outer edge of said inner portion faceplate, a surface of said end ring positioned in substantially the same plane as a surface of said lip of said outer portion when said inner portion is positioned within said outer portion.

12. An insert in accordance with claim 8, wherein a surface of said spout is positioned in substantially the same plane as a surface of said lip of said outer portion when said inner portion is positioned within said outer portion.

13. An insert in accordance with claim 8, wherein said inner portion is secured in said outer portion by at least one of friction, a tongue and groove, and a screw thread.

14. An insert in accordance with claim 8, wherein said outer portion is secured within the inverted dispenser by at least one of friction, a tongue and groove, and a screw thread.

15. An insert for an inverted dispenser, said insert comprising:

a frusto-conical body having a sidewall, a bottom end, and a top end forming a cavity therein;

an opening extending through said sidewall and positioned adjacent to said top end;

a spout extending axially from a center of said top end; and a cylindrical dispensing tube extending axially from said spout and through said cavity without contacting said bottom end such that said spout is in fluid communication with said cavity through said dispensing tube.

16. A method of forming an insert for an inverted dispenser, said method comprising:

forming an outer portion having a frusto-conical body, a bottom end, and a cavity extending through the frusto-conical body;

extending an outer opening through a sidewall of said frusto-conical body;

extending a lip circumferentially around the frusto-conical body;

forming an inner portion having a cylindrical faceplate;

axially extending a spout from a center of the faceplate;

axially extending a cylindrical dispensing tube from said spout and through said cavity without contacting said bottom end of the outer portion; and positioning the inner portion within the outer portion such that the inner portion faceplate is positioned within the outer portion lip, and such that the spout is in fluid communication with the cavity extending through the outer portion.

17. A method in accordance with claim 16, wherein the outer portion opening is formed so that the cavity of the outer portion is in fluid communication with a cavity of the inverted dispenser when the insert is positioned within the inverted dispenser.

18. A method in accordance with claim 16 further comprising positioning the inner portion within the outer portion so that a surface of the spout of the inner portion is substantially planar with a surface of the lip of the outer portion.

* * * * *